US006035489A

United States Patent [19]

Adams

[11] Patent Number: 6,035,489

[45] **Date of Patent: *Mar. 14, 2000**

[54] HINGEABLE AND SEPARABLE COUPLING DEVICE

[76] Inventor: Thomas J. Adams, 154 Prairiewood Dr., Fargo, N. Dak. 58103

[ * ] Notice: This patent issued on a continued prosecution application filed under 37 CFR 1.53(d), and is subject to the twenty year patent term provisions of 35 U.S.C. 154(a)(2).

[21] Appl. No.: 08/662,996

[22] Filed: Jun. 17, 1996

[51] Int. Cl.[7] ..... E05D 7/10

[52] U.S. Cl. ..... 16/229; 16/257

[58] Field of Search ..... 16/229, 257–259, 16/261, 230, 231; 403/321, 322.1, 322.4, 324, 325

[56] References Cited

U.S. PATENT DOCUMENTS

| | | | |
|---|---|---|---|
| 726,577 | 4/1903 | Schiek | 16/229 |
| 2,903,735 | 9/1959 | Schneider | 16/229 |
| 3,338,609 | 8/1967 | Banas | 16/229 |
| 4,178,657 | 12/1979 | Way, Jr. | 16/229 |
| 4,302,866 | 12/1981 | Irvin | 16/257 |
| 4,422,688 | 12/1983 | Kameoka | 16/229 |
| 4,455,711 | 6/1984 | Anderson | 16/229 |
| 4,495,672 | 1/1985 | Adams | 16/229 |
| 4,594,750 | 6/1986 | Carcas | 16/229 |
| 5,274,882 | 1/1994 | Persson | 16/229 |

FOREIGN PATENT DOCUMENTS

| | | | |
|---|---|---|---|
| 1184393 | 12/1964 | Germany | 16/229 |
| 2033465 | 5/1980 | United Kingdom | 16/257 |

*Primary Examiner*—Chuck Y. Mah
*Assistant Examiner*—Donald M. Gurley
*Attorney, Agent, or Firm*—David A. Lingbeck

[57] ABSTRACT

A hingeable and separable coupling device for coupling two objects together includes a first connectable member having a pair of holes, a shaft having an end which is slidably and biasedly extended through one of the holes of the first connectable member, a sleeve having a stub which is slidably and biasedly extended through another of the holes of the first connectable member, a pair of flanges one of which is mounted to the sleeve for the movement thereof and the other of which is mounted to the shaft for the movement thereof, a second connectable member having a pair of holes one for receiving the end of the shaft and another for receiving the stub of the sleeve, and a lever being pivotally attached to the first connectable member and having a pair of tapered projecting members for engaging and moving the flanges which in turn retracts the stub and the end of the shaft from the holes of the second connectable member and which uncouples the two connectable members.

4 Claims, 3 Drawing Sheets

HINGEABLE AND SEPARABLE COUPLING DEVICE

BACKGROUND OF THE INVENTION

The present invention relates to a hingeable and separable coupling device for hingedly coupling two objects which can be easily separated from one another such as a door being hingedly coupled to a door jamb or a lid hingedly coupled to a container.

Most objects which are hingedly coupled to other complimentary objects are essentially permanently coupled to each other such as lids being coupled to containers. There are some objects such as doors which can be separated from the door jambs but only with difficulty and with some patience. In most instances, there is a need to separate two objects which are coupled to one another, either for repairing one or the other or for cleaning the two objects and the prior art describes a few inventions which allows the users to quickly and hingedly attach and detach one object to another object.

One known prior art is an EMERGENCY OPENING LATCH, U.S. Pat. No. 3,338,609, issued on Aug. 29, 1967 and invented by H. C. Banas, which comprises a central coupling section, an outer section pivotally connected to the central coupling section, an arm member pivotally secured to the central coupling section, and a releasing means being secured to the arm member for disengaging the outer section from the central coupling section.

Another known prior art is a RELEASABLE HINGE FOR SWINGABLE PORTIONS OF A CONTAINER, U.S. Pat. No. 4,302,866, issued on Dec. 1, 1981 and invented by Ronald D. Irvin, which comprises a pair of spring fingers and a blind notch on the cover and bottom walls of a container for receiving the spring fingers.

Another known prior art is a HINGE HAVING A LATERALLY OUTWARDLY EXTENDING FLAT SPRING, U.S. Pat. No. 4,455,711, issued on Jun. 26, 1984 and invented by John P. Anderson, which comprises a housing having a first tube thereon, a pin for sliding in the first tube, and a flat spring having a first end and a second end fixed to the pin.

None of the prior art discloses or suggests the present invention which allows the user to quickly and easily couple two objects together by simply depressing a lever.

SUMMARY OF THE INVENTION

This invention relates to a hingeable and separable coupling device which comprises a first connectable member having a pair of aligned holes one of which extends through one side wall and the other of which extends through the other side wall, the first connectable member further having a spring support extending upward from the bottom wall. The hingeable and separable coupling device further comprises a second connectable member having a pair of aligned holes each of which extends through a respective side wall thereof, the side walls being adapted to receive therebetween at least portions of the side walls of the first connectable member. A connecting means comprising a shaft movably extending in a sleeve having a spring member disposed inside thereof, couples the two connectable members together. An uncoupling means comprises a lever pivotably attached to the side walls of one of the connectable members for uncoupling the two connectable members.

One objective of the present invention is to provide a hingeable and separable coupling device which allows a user to quickly and easily couple and decouple two objects.

Another objective of the present invention is to provide a hingeable and separable coupling device which not only allows the user to couple and decouple two objects but also allows one object to be hinged to the other object.

Further objectives and advantages of the present invention will become apparent as the description proceeds and when taken in conjunction with the accompanying drawings wherein:

DETAILED DESCRIPTION OF THE INVENTION

Figure 1:
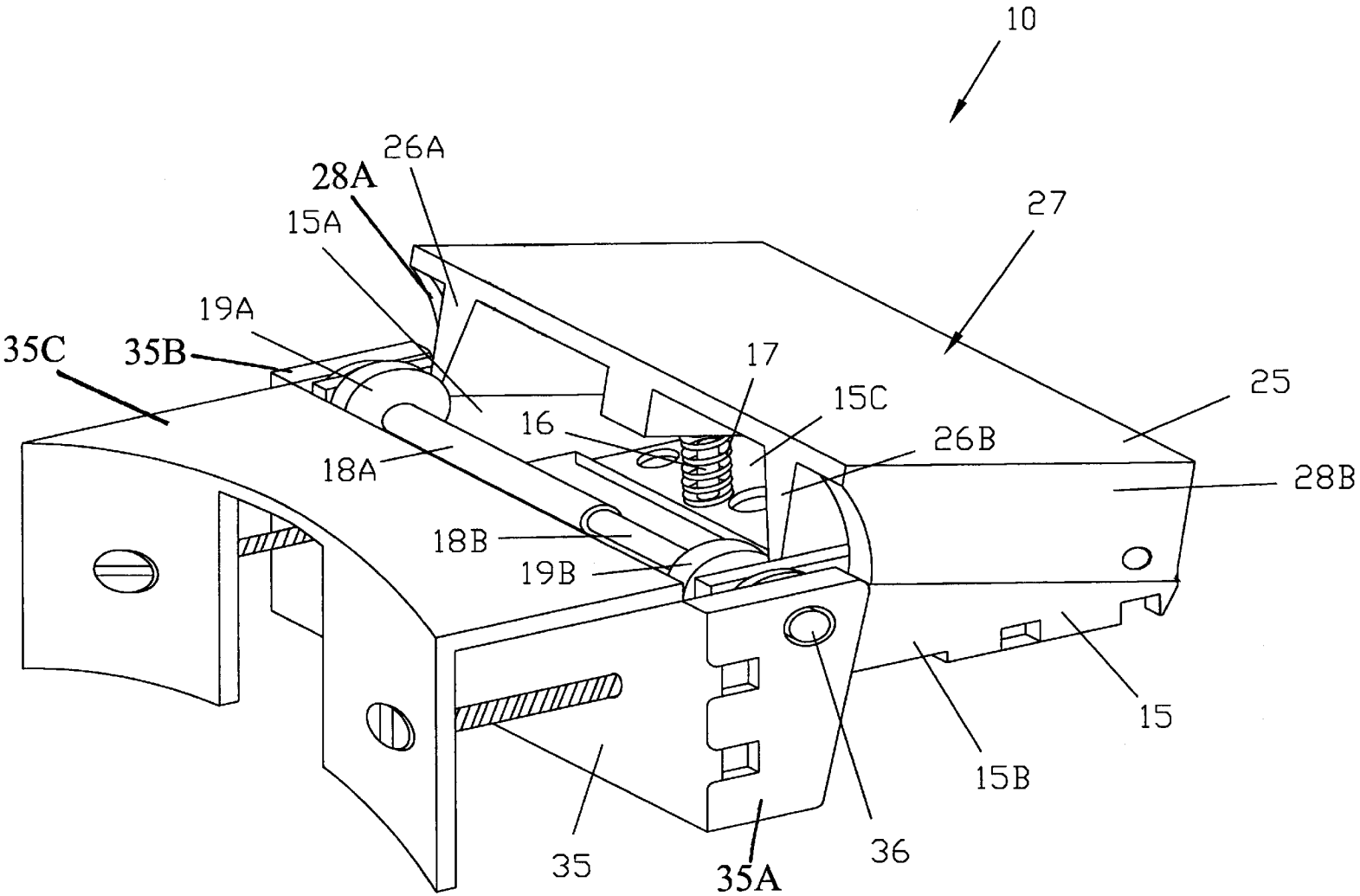
FIG. 1 is a perspective view of the hingeable and separable coupling device.
Figure 2:
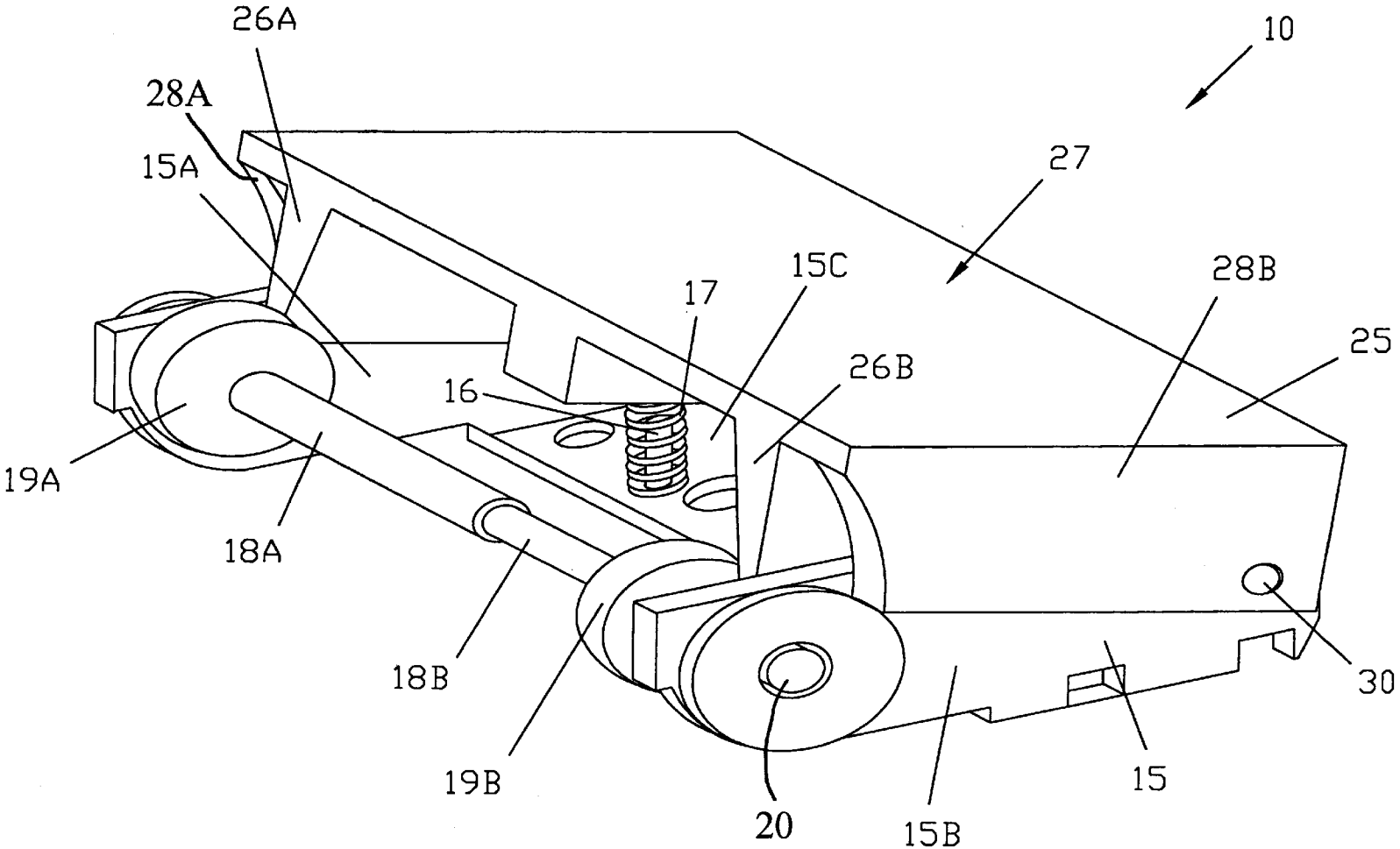
FIG. 2 is a perspective view of the first connectable member, connecting means, and uncoupling means of the hingeable and separable coupling device.
Figure 3:
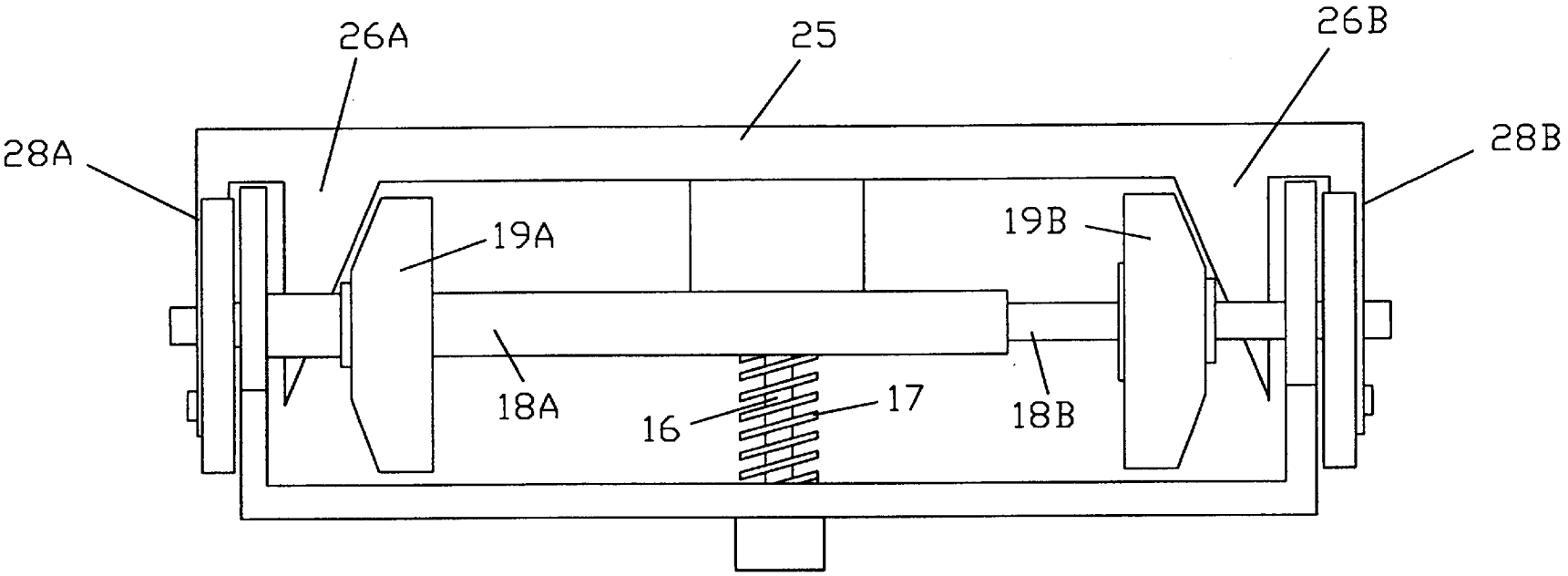
FIG. 3 is a front elevation view of the first connectable member, connecting means, and uncoupling means of the hingeable and separable coupling device with the uncoupling means depressed to retract the connecting means.

Referring to the drawings in FIGS. 1–3, in particular, the hingeable and separable coupling device 10 comprises a first connectable member 15 having a generally rectangular main wall 15C and further having a front end, back end, and two side walls 15A–B with a pair of holes 20 being in general alignment to one another wherein each of the holes 20 extend through a respective side wall near the front end of the first connectable member 15 which also has a spring support 16 integral to and extending upward from a middle portion of the main wall 15C, the spring support 16 being adapted so that a compression spring 17 fits about and is supported by the spring support 16. The hingeable and separable coupling device 10 further comprises a second connectable member 35 which has a generally rectangular main wall 35C and further having a front end, back end, and two side walls 35A–B with a pair of holes 36 being in general alignment to one another wherein each of the holes 36 extend through a respective side wall near the back end of the second connectable member 35, the side walls 35A–B of the second connectable member 35 being spaced such that a portion of the side walls 15A–B of the first connectable member 15 at the front end thereof is adapted to fit between the side walls 35A–B of the second connectable member 35 with the holes 20 of the first connectable member 15 being in alignment to the holes 36 of the second connectable member 35.

The first 15 and second connectable members 35 are hingedly coupled to one another by means of a connecting means which includes a shaft 18B having a first end slidably extending through one of the holes 20 of the first connectable member 15 and a second end which is slidably extending in a second end of a sleeve 18A which has a first end to which a stub is fixedly attached and slidably extends through the other one of the holes 20 of the first connectable member 15, the stub having a circumference comparable to that of the shaft 18B. A conventional compressible spring member is disposed inside the sleeve 18A and urges against the first end of the sleeve 18A and the second end of the shaft 18B such that the shaft 18B and sleeve 18A are being urged in opposite directions with the stub and the first end of the shaft 18B biasedly extending through the holes 20 of the first connectable member 15 such that the stub and first end of the shaft 18B are exposed to the outside of the side walls 15A–B of the first connectable member 15 and are capable of extending through the holes 36 of the second connectable member 35 to hingedly couple the two connectable members together. A pair of flanges 19A–B are fixedly attached to the connecting means with one flange 19A being attached about the sleeve 18A near the first end thereof and being abuttable against one of the side walls 15A–B of the first connectable member 15 and with the other flange member 19B being attached to the shaft 18B near the first end thereof and being abuttable against the other side wall 15A–B of the first connectable member 15.

An uncoupling means having a lever 25 which includes a front end, back end, a main wall 27, and a pair of side walls 28A–B is pivotally attached at its side walls 28A–B to the side walls 15A–B of the first connectable member 15 for retracting the stub and first end of the shaft 18B from the holes 36 of the second connectable member 35 so that the second connectable member 35 can be separated from the first connectable member 15 and also allows for the coupling of the second connectable member 35 to the first connectable member 15.

A pair of elongated projecting members 26A–B extend and are tapered downwardly from the bottom of the main wall 27 of the lever 25 and extend from the front end to the back end of the lever 25 and parallel to the side ends of the lever 25, wherein each elongated projecting member is disposed near and spaced from a respective side end of the lever 25 with the bottom edge of each projecting member being in a plane which passes essentially between a respective side wall of the first connectable member 15 and a respective flange 19A–B when the respective flange is abutting against the respective side wall of the first connectable member 15. The projecting members 26A–B are biased out of contact with the connecting means by the compression spring 17 which rests upon the main wall 15C of the first connectable member 15 and which urges against the main wall 27 of the lever 25 to essentially raise the front end of the lever 25 so that the front ends of the projecting members 26A–B are not in contact with the side walls 15A–B of the first connectable member 15 and the flanges 19A–B. The projecting members 26A–B can be brought into contact with the side walls 15A–B of the first connectable member 15 and the flanges 19A–B by the user moving the front end of the lever 25 downwardly toward the main wall 15C of the first connectable member 15. As the lever 25 is moved downwardly, the front ends of the projecting members 26A–B wedge and engage between the-side walls 15A–B of the first connectable member 15 and the flanges 19A–B and urge the flanges 19A–B toward each other and away from the nearest side walls 15A–B of the first connectable member 15 and since the flanges 19A–B are fixedly attached one to the sleeve 18A and the other to the shaft 18B, the projecting members 26A–B also retract the stub and the first end of the shaft 18B into the holes 20 of the first connectable member 15 to either release and uncouple the second connectable member 35 from the first connectable member 15 by retracting the stub and shaft 18B from engagement with the second connectable member 35 or allow the coupling of the first connectable member 15 to the second connectable member 35 by allowing the user to position the side ends of the second connectable member 35 about the side ends of the first connectable member 15 so that the holes of both connectable members line up making it possible for the stub and first end of the shaft 18B to extend through the holes thus hingedly coupling the two connectable members.

To couple two objects together, (1) the user fastens the first connectable member 15 to a portion of one object with screws or bolts and also fastens the second connectable member 35 to a portion of the other object with screws or bolts; (2) then the user depresses the lever 25 to engage the front ends of the projecting members 26A–B between the flanges 19A–B and the side walls 15A–B of the first connectable member 15 so that the flanges 19A–B moves away from the respective side walls 15A–B which retracts the stub and the first end of the shaft 18B sufficiently so that the side walls 35A–B of the second connectable member 35 can be positioned about the side walls 15A–B of the first connectable member 15 with holes of both connectable members being put into alignment; (3) next, the user releases the lever 25 which springs upward thus moving the projecting members 26A—B out of contact with the connecting means, wherein the spring member urges the shaft 18B and the sleeve 18A in opposite directions with the stub and first end of the shaft 18B moving outward through the holes 36 of the second connectable member 35 thus hingedly coupling the two connectable members.

To uncouple the two objects, the user repeats step 2 of the coupling process, and once the two connectable members are separated, the user can release the lever 25 which resets the stub and first end of the shaft 18B in their normal coupling positions.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A hingeable and separable coupling device comprising:

a first connectable member fastenable to an object;

a coupling means mounted to said first connectable member which has holes through which a portion of said coupling means movably extends, said first connectable member also having side walls and a main wall, said holes extending through said side walls, said coupling means comprising a sleeve having a first end and second end and a shaft having a first end and a second end and a stub attached to said first end of said sleeve and a spring disposed within said sleeve for biasedly urging said shaft and said sleeve in opposite directions and for biasedly urging said stub and said first end of said shaft into a coupling position, said second end of said shaft extending in said second end of said sleeve, each of said stub and said first end of said shaft retractably extending through said holes in said first connectable member;

a second connectable member hingeably and detachably coupled to said first connectable member by said coupling means and being fastenable to an object; and an uncoupling means mounted to said first connectable member to detach said second connectable member from said first connectable member, said uncoupling means further including a pair of flanges one of which is fixedly mounted about said sleeve and the other of which is fixedly mounted about said shaft for movement of said sleeve and said shaft therewith, said uncoupling means also including a lever for moving said flanges along with the attached sleeve and shaft toward each other upon pivoting the lever toward the first connectable member being pivotally connected to said first connectable member, said uncoupling means further having a plurality of projecting members which extend from said lever for moving said flanges along with the attached sleeve and shaft toward each other upon pivoting the lever toward the first connectable member.

2. A hingeable and separable coupling device as described in claim 1, wherein said projecting members are tapered downwardly and are positioned in a contactable relationship with said flanges, said lever being movable toward said first connectable member such that said projecting members contact said flanges and move said flanges toward one another, thus resulting in the movement of said sleeve and said shaft in opposite directions and for retracting said stub and said first end of said shaft to uncouple said second connectable member from said first connectable member.

3. A hingeable and separable coupling device as described in claim 2, wherein each of said projecting members is slidably engageable between a respective side wall of said first connectable member and a respective said flange for urging a respective said flange away from a respective said side wall of said first connectable member.

4. A hingeable and separable coupling device as described in claim 3, wherein each of said projecting members is tapered such that as said lever is moved closer toward said first connectable member, a respective said flange is moved farther away from a respective said side wall of said first connectable member and both said stub and said first end of said shaft are further retracted.

* * * * *